United States Patent [19]

Salmon

[11] 3,999,703

[45] Dec. 28, 1976

[54] AXIAL SCREW SLUDGE PUMPING

[75] Inventor: John Kennedy Salmon, Glen Cove, N.Y.

[73] Assignee: Lundy Electronics & Systems, Inc., Glen Head, N.Y.

[22] Filed: Aug. 27, 1973

[21] Appl. No.: 392,027

[52] U.S. Cl. ..... 233/7; 233/19 R; 233/22; 233/46; 210/369; 214/17 DB

[51] Int. Cl.[2] ..... B04B 1/20

[58] Field of Search ..... 233/3, 4, 21, 46, 22, 233/7, 27, 47 R, 19 R; 198/64; 214/17 DB; 259/10, 9; 210/369, 372

[56] References Cited

UNITED STATES PATENTS

| | | | |
|---|---|---|---|
| 407,392 | 7/1889 | Barnes | 233/3 |
| 980,001 | 12/1910 | Ponten | 233/27 |
| 3,081,027 | 3/1963 | Coulson | 233/21 X |
| 3,247,972 | 4/1966 | Woodall et al. | 210/369 |
| 3,451,531 | 6/1969 | Barnes | 198/64 X |
| 3,696,950 | 10/1972 | Peters | 214/17 D |
| 3,718,220 | 2/1973 | Titus | 233/22 X |

*Primary Examiner*—George H. Krizmanich
*Attorney, Agent, or Firm*—Brumbaugh, Graves, Donohue & Raymond

[57] ABSTRACT

This invention is concerned with axial conveying of sludge through a stationary tube from inside to outside a rotating centrifuge. It incorporates a high speed auger screw to move the material. High speed implies spinning of the auger too fast for sludge adhesion, and operating the auger only partially full. The feed to the auger is by an unrestrained jet of material from which any material not driven axially by the auger is permitted to fall freely away from the auger feed section. The combination of high rotational forces, open ballistic feed, and partially full screw, combine to assure transport of thixotropic materials.

3 Claims, 3 Drawing Figures

AXIAL SCREW SLUDGE PUMPING

BACKGROUND OF THE INVENTION

The transfer of thixotropic materials through a pipe, trough or other similar vessel frequently presents many unusual problems. The apparent viscosity of the thixotropic material can be greatly reduced by rapid stirring prior to the entry into the relative quiet of a vessel such as a pipe. If the force is sufficiently great, and residual turbulence from the rapid stirring still pronounced, the introduction of the material presents no unusual problems. However, if the pipe is long or if the diameter of the pipe is large, and it runs full, producing relatively low flow velocity, the viscosity of the thixotropic material can increase rapidly and plugging can occur. Attempts to force the material or plug through the pipe by increased pressure frequently fail. In many cases increased pressure results in removing additional liquid from the plug, thus making the movement of the plug even more difficult. The transfer of such material in a pipe is very difficult particularly if there is a rapid change in direction.

One of the areas where movement of thixotropic materials is particularly troublesome is in centrifuges. In my coexecuted application, Controlled Axial Movement in a Centrifuge, Ser. No. 392,011, filed Aug. 27, 1973, now abandoned, a method for axial moving thixotropic materials in a rotating centrifuge is disclosed. The rapidly stirred material in the centrifuge is removed from its rim by a scoop which forces the material towards the center of rotation. At this point the material must change direction to be removed from the centrifuge. Frequently, if a simple pipe is used, partial blocking of the axial pipe occurs. This further aggravates the problem as further movement is restricted. The net result is that additional material may build up and finally in many cases complete blockage results.

SUMMARY OF THE INVENTION

Thus, one of the objectives of this invention is to provide a method for transporting liquids, slurries, thixotropic material, and sludges in particular, through a pipe or other confined vessel. Another object of this invention is to provide a process for removing materials from a rotating centrifuge. Other objectives will be apparent as the invention is disclosed.

Ideally, the axial driving device should have several capabilities to handle a broad range of materials, including thixotropic materials such as sludges. The device should provide rapid stirring to keep the material flowable. In addition, the device should be capable of transporting those materials not normally considered pumpable. In addition, the device should be self-cleaning, in the sense that positive wiping of the internals during operation prevents packing of its interior. Finally, the entry of the material to the device must preclude the possibility of the fed material bridging across the entry zone and preventing further feed.

In the descriptive matter to follow, particular reference will be made to the applicability of this invention in the removal of the thixotropic material from centrifuges, but is should be recognized that it is broadly applicable to removing many materials from centrifuges and is equally valuable in transporting many other materials in other devices and arrangements.

These objectives are achieved by providing a high speed auger which tends to drive the thixotropic material axially along the pipe. The effectiveness of the auger is dependent upon the relative adhesions of the thixotropic material to the pipe wall, and to the auger screw surface. If the sludge sticks to the wall sufficiently it cannot speed up in rotation around the pipe to the angular speed of the screw. The screw, therefore, acts as a wedge, driving the sludge axially. However, if the sludge adheres to the screw, thus matching its rotational speed, it will gradually fill the threads in the auger and pumping action will cease.

As the material from the scoop or other feed sources hits the high speed auger it will tend to cling to the screw if the adhesive force between the sludge and the screw is high. The opposing forces tending to remove the material from the screw are dependent upon the speed and design of the auger. Thus, by proper choice of auger speed, diameter and pitch, the centrifugal forces at radii less than the auger radius can be made to exceed the adhesive strength of the bond between sludge and auger. Thus, in operation, the material is forced to the wall of the tube or trough. Further, the angular rotation of the auger is such that the cohesive strength of the sludge must be high if it is to follow the auger and not be forced against the wall. Since the speed of the auger can be increased, the cohesive strength of the sludge can be exceeded. In addition, the rapid motion of the auger tends to stir the material as it is thrown against the wall. This rapidly reduces the viscosity and fluidizes the mixture.

The high speed auger feed also tends to compensate for variable material characteristics. The more a material tends to adhere to the screw, the faster it moves, and the greater the centrifugal load tending to release it. Thus, the screw is self-releasing. Conversely, the more rapidly the material spins against the retaining tube, the more it tends to drag. Hence, the greater is its motion relative to the screw. Both actions aid transporting.

Again, even with a fluid or slurry of low viscosity, transporting is effective, since the high speed auger, when the material enters between flights, drives it axially. The material's own inertia reacts against the auger forces to provide the relative tangential slipping which assures axial progress through the device.

Finally, by providing a screw operating at high speeds so that the nominal capacity of the screw, based on its diameter, pitch, and speed, is high compared to the transport rate, the space for the sludge between auger flights exceeds the sludge volume. In the preferred case the nominal capacity exceeds the transport volume by at least 100%, therefore, there is no tendency for liquid to be forced out of the sludge under pressure.

In order to feed the high speed auger, or screw, properly, special care must be taken. With thixotropic materials, if the feed material is allowed to rest, the viscosity will increase and feeding may be interrupted. It is preferred, therefore, to leave a large open space between the end of the scoop tube and auger trough. The auger's pickup area should be enclosed only in a partial tube so that no pocket of sludge can form around it and bridge across.

In the preferred arrangement it is not necessary to carefully limit the feed rate to the device in order to maintain the above mentioned excess of screw capacity over transported volume. The partial tube at the auger pickup area automatically limits the transported material volume since only a portion of the material which is provided to the device will be driven axially into the full tube. Since the auger is rotating rapidly, much of the material hitting the auger will be thrown off the screw and returned to the bowl. Some will, however, be axially transported out of the centrifuge.

It is also useful in some cases to use a partially open tube or trough, for example generally U-shaped in cross section, rather than a closed tube for the scoop which feeds the auger. This permits the sludge to fall freely or escape from the scoop in the event of a minor blockage of the scoop itself. The blockage merely diverts the sludge out of the open surface of the scoop, and does not interrupt upstream flow. Continued flow erodes the blockage and the scoop become self-cleaning.

Although the invention has been described in relation to its use in removing thixotropic material from a centrifuge, it is apparent that the same process can be used for transporting materials generally. The invention will be understood by reference to the following embodiments.

DESCRIPTION OF PREFERRED EMBODIMENTS

Figure 1:
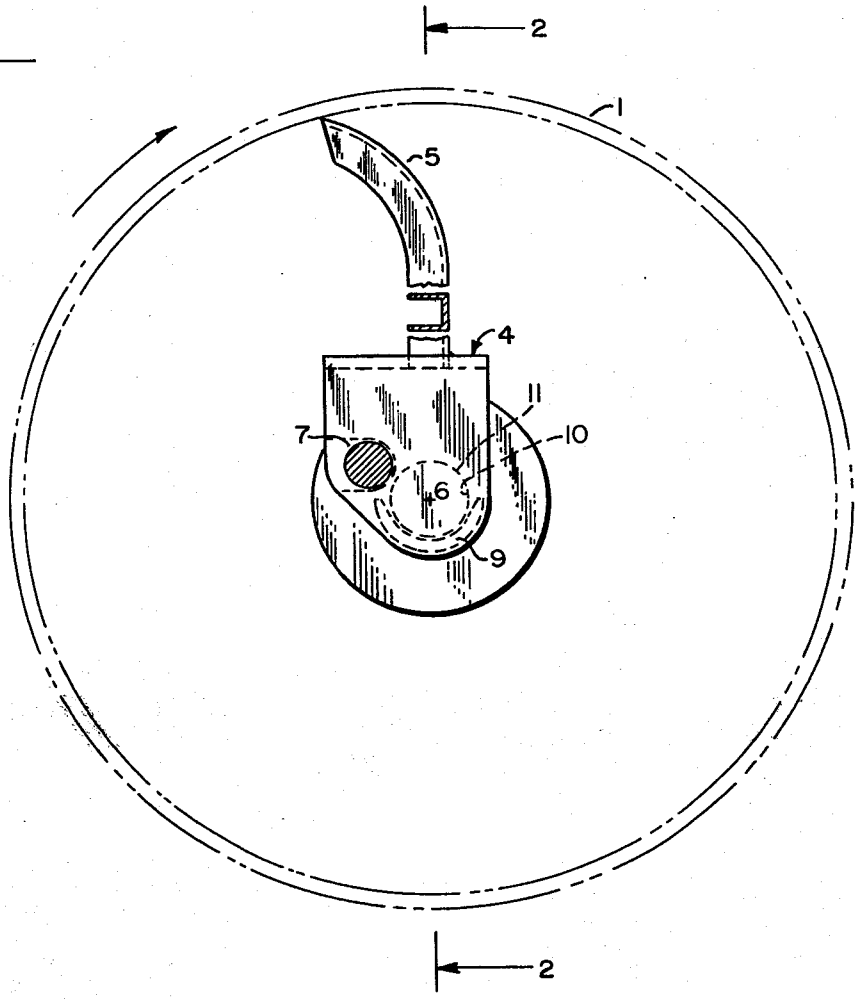
FIG. 1 is an end view of a first embodiment of an axial screw sludge pumping system according to the invention.
Figure 2:
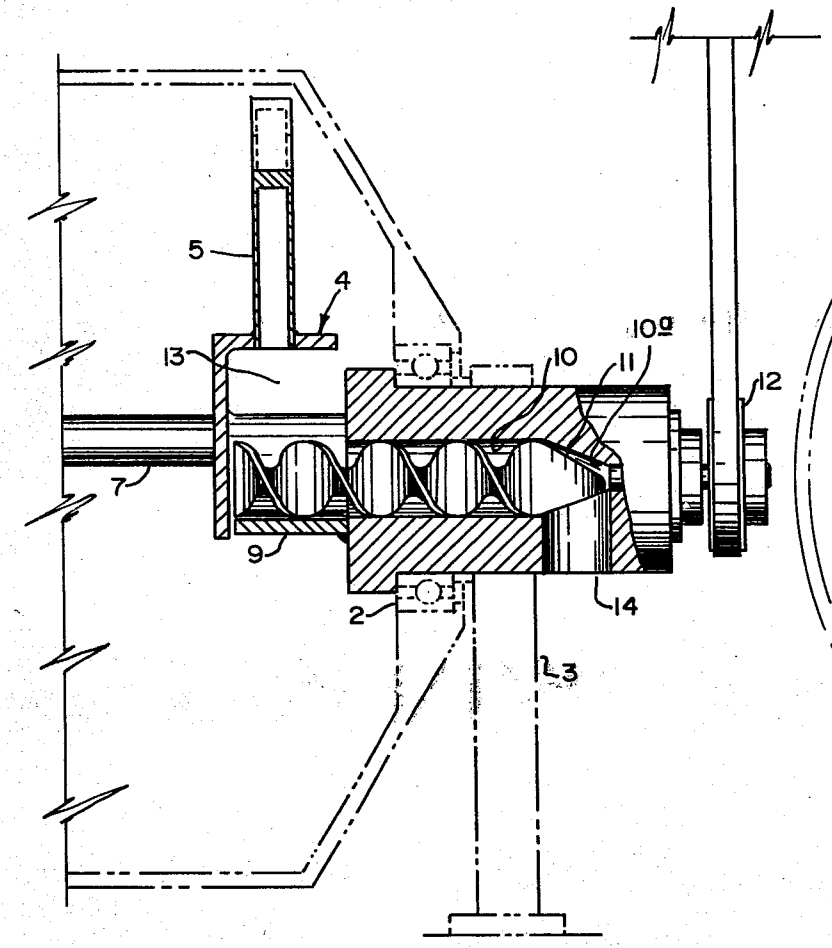
FIG. 2 is a view taken along the line 2—2 of FIG. 1 and looking in the direction of the arrows.

In FIGS. 1 and 2, a baffled centrifuge bowl 1, rotated on bearings 2, which operate with inner diameters affixed to nonrotating mount 3, is equipped to remove sludge by means of a scoop assembly 4, consisting of a scoop 5, pivoted about the scoop rotation shaft 7, which is eccentric to the center of bowl rotation 6. In operation, the scoop assembly is rotated so that the scoop enters the pool of sludge to be removed from the bowl. The scoop 5 diverts the rapidly moving sludge through its own length and directs a stream of sludge toward the fixed collector-trough 9 which consists of a portion of a cylindrical tube. This trough is affixed to and is an extension of a cylindrical tube 10 fixed to mount 3. Within this tube is an auger 11 which extends out of tube 10 and over trough 9.

The auger, which may consist of a twisted plate, or of a cylindrical core with flutes, is rotated with respect to ground by some external means. As drawn, this is a pulley drive 12, but any drive means is within the intent of the disclosure. The sludge passes unrestrained across gap 13 between scoop 5 and trough 9. Auger 11, rotating rapidly, drives a portion of the sludge along tube 10 and out port 14. The angle between tubes 14 and 10 is traversed by the sludge using three effects. First, the material reaches a sloping end 10*a* on tube 10, and is deflected down. Second, material moving with the scoop is thrown off centrifugally through tube 14. Third, the auger shape and the end 10*a* of the tube 10 are mated, with small clearance, so that any material build up is machined off tube 10 and, by the two means noted above, driven through 14. Sludge which is not picked up at 9 is dropped back into the rotating bowl 1 for another pickup by tube 5.

The gap between tube 5 and trough 9, and the openness of trough 9 in comparison to a complete or nearly complete cylinder assure that sludge not transported through tube 10 is not held or compacted. This prevents bridging of the sludge on the hardware and precludes pressure dewatering of such sludge.

FIGS. 1 and 2 show the auger driven by external means. This technique is useful under three conditions, as follows:

1. Auger speed is not the same as bowl speed or both do not run at the same time.
2. Scoop assembly 4 incorporates a shaft which extends into the bowl, possibly carrying other devices. Such a shaft would preclude affixing the auger to bowl.
3. The auger is not on the center of rotation of the bowl.

Figure 3:
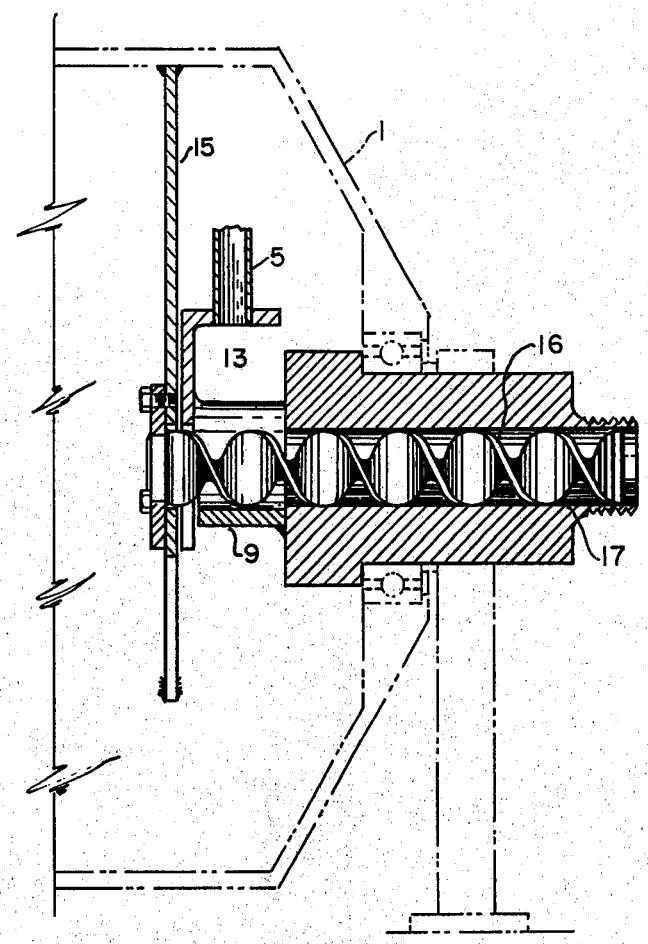
FIG. 3 is a partially sectioned view of a second embodiment of the invention.

When these limitations do not interfere, the auger may be affixed to the centrifuge bowl as in the embodiment illustrated in FIG. 3.

In this figure the auger 16 is driven by and attached to the bowl 1 by means of the member 15, rotating with them. The tube 17, which receives the auger 16, can then extend directly out of the centrifuge without requiring the transported material to turn corners to exit, as it does in the FIGS. 1 and 2 embodiment. The high angular velocity of the auger precludes sticking of pumped material, and assures stirring of the pumped material.

The invention is illustrated, but not limited, by the following example:

EXAMPLE 1

A cylindrical horizontal centrifuge of about 12 working gallons capacity was fitted with a movable solids-removal scoop with 0.87 inch diameter passage, traversable to within 0.06 inch of the centrifuge wall, and with stirrers capable of moving material axially in the centrifuge in accordance with coexecuted application, Controlled Axial Movements in a Centrifuge, Ser. No. 392,011, filed Aug. 27, 1973, now abandoned. The stirrers and scoop were used to scoop the sludge contents of the bowl with the bowl rotating at 1,320 rpm. The scoop was arranged to direct the flow toward the exposed flutes of an auger with a 1.25 inch diameter and pitch of 1.5 inch rotating at 500 rpm, driven by external pulley as in FIGS. 1 and 2.

The scoop directed the flow toward the auger, which transported it approximately 10 inches axially out of the centrifuge bowl. The scoop/auger system ejected the sludges developed during approximately 50 hours of treating sewage from the centrifuge. The ejected sludge concentration ranged up to 6.6% dry solids. During various runs, the sludge included settled sewage solids as well as settled solids augmented by addition of 200 mg/liter $FeCl_3$ to the sewage influent system.

It will be recognized that there are a number of modifications and combinations possible and these combinations and variations which are apparent to anyone skilled in the art are included within the scope of the invention.

What is claimed is:

1. Apparatus for removing materials from a centrifuge comprising:

a. a scoop mounted within the centrifuge and having an outer end for receiving the materials to be removed and an inner end from which the received materials are directed, b. an auger mounted for rotation with respect to the scoop and having an end extending into the centrifuge for picking up the materials directed from the inner end of the scoop, and c. a tube communicating the interior of the centrifuge with the exterior thereof and receiving the auger for rotation therein, the inner portion of the tube only partially enclosing the pickup end of the auger, the inner partially enclosing portion of the tube being disposed on the side of the auger remote from the inner end of the scoop, d. the inner end of the scoop being spaced from the pickup end of the auger and from the portion of the tube that only partially encloses the auger so as to provide a space in communication with the interior of the centrifuge, whereby a portion of the materials directed from the scoop will be thrown off the auger through the space between the inner end of the scoop and the partially enclosing portion of the tube and returned to the centrifuge, and a portion of the materials directed from the scoop will be transported axially of the auger out of the centrifuge.

2. Apparatus according to claim 1 wherein the scoop is formed with an open side to enable the materials being conveyed therethrough to escape through the open side should a blockage develop in the scoop.

3. Apparatus for removing materials from a centrifuge comprising:

a. a scoop mounted within the centrifuge and having an outer end for receiving the materials to be removed and a tubular portion for directing the flow of those materials, the tubular portion having an open side to enable the materials being conveyed therethrough to escape through the open side should a blockage develop in the scoop, b. an auger mounted for rotation with respect to the scoop and having an end extending into the centrifuge for picking up the materials directed from the scoop, and c. a tube communicating the interior of the centrifuge with the exterior thereof and receiving the auger for rotation therein.

* * * * *